US005626001A

United States Patent [19]

Belec

[11] Patent Number: 5,626,001

[45] Date of Patent: May 6, 1997

[54] SHINGLED MATERIAL ROLL FEED FOR MAIL INSERTION SYSTEM

[75] Inventor: Eric A. Belec, Southbury, Conn.

[73] Assignee: Pitney Bowes Inc., Stamford, Conn.

[21] Appl. No.: 646,894

[22] Filed: May 8, 1996

[51] Int. Cl.[6] ..... B65B 41/00; B65B 41/12; B65B 61/00

[52] U.S. Cl. ..... 53/284.3; 53/389.2; 53/569

[58] Field of Search ..... 53/284.3, 381.5, 53/389.2, 389.4, 569

[56] References Cited

U.S. PATENT DOCUMENTS

| | | | |
|---|---|---|---|
| 3,710,533 | 1/1973 | Burns | 53/389.4 X |
| 4,524,557 | 6/1985 | Silverman et al. | 53/284.3 X |
| 4,852,334 | 8/1989 | Auerbach | 53/284.3 X |
| 5,107,656 | 4/1992 | Katz et al. | 53/284.3 X |
| 5,282,350 | 2/1994 | Crowley | 53/284.3 X |

*Primary Examiner*—Horace M. Culver
*Attorney, Agent, or Firm*—Christopher J. Capelli; Melvin J. Scolnick

[57] ABSTRACT

An inserting system for inserting documents into an envelope. The system comprises: an inserting chassis; a device to convey documents from an upstream location on the chassis to a downstream location on the chassis; an insertion station for inserting the documents into a waiting envelope; a feeder located adjacent the inserter chassis for feeding documents to the conveying device, the feeder having a hopper for storing the documents; a forms unwinder located adjacent the feeder, the unwinder having a pivotable support arm; a roll of shingled documents mounted on the support arm; a device for unwinding the roll and separating each succeeding document seriatim; and a device for feeding the separated documents into the feeder hopper. In an alternative embodiment of the instant invention, the foregoing elements of the invention are the same except that the unwinder is used to store and unwind envelopes.

6 Claims, 5 Drawing Sheets

SHINGLED MATERIAL ROLL FEED FOR MAIL INSERTION SYSTEM

BACKGROUND OF THE INVENTION

The instant invention relates to mail insertion apparatus and more particularly to apparatus for loading the individual feeders for envelopes and documents to be inserted into the envelopes.

For many years now, billing forms, e.g. statements, have been supplied to mail insertion systems by means of a continuous web format in the form of a roll. The rolled web is unwound and the billing pieces are separated from the web by a cutter or burster and processed into the inserter mailstream. The use of continuous forms in a roll format has resulted in a tremendous increase in efficiency associated with forms processing. Operators of insertion systems can automatically unwind the roll web into the inserter; 70,000 sheets of uninterrupted forms can be provided in this manner to the inserter system before the roll will be depleted and another roll would have to be installed. The innovation of the roll web has largely automated the computer generated, input forms processing associated with current insertion systems operation.

Unlike the processing for the roll webs, the enclosure and envelope processing devices associated with insertion equipment have not progressed to a point approaching automation. The current, state of the art enclosure and envelope feeding apparatus on modern insertion systems includes manual loading of enclosures and envelopes into their respective feeding devices. This manual loading, in turn, has limited the automation potential of the inserter system as a whole.

Accordingly, the instant invention provides a bulk material handling solution which has the ability to provide extended inserter systems operation with vastly reduced operator intervention. The material handling apparatus of this invention can be incorporated into systems having virtually any mechanical architecture.

SUMMARY OF THE INVENTION

Thus, the instant invention provides an inserting system for inserting documents into an envelope. The system comprises: an inserting chassis; means to convey documents from an upstream location on the chassis to a downstream location on the chassis; an insertion station for inserting the documents into a waiting envelope; a feeder located adjacent the inserter chassis for feeding documents to the conveying means, the feeder having a hopper for storing the documents; a forms unwinder located adjacent the feeder, the unwinder having a pivotable support arm; a roll of shingled documents mounted on the support arm; means for unwinding the roll and separating each succeeding document seriatim; and means for feeding the separated documents into the feeder hopper.

In an alternative embodiment of the instant invention, the foregoing elements of the invention are the same except that the unwinder is used to store and unwind envelopes.

DETAILED DESCRIPTION OF THE PREFERRED EMBODIMENT

Figure 1:
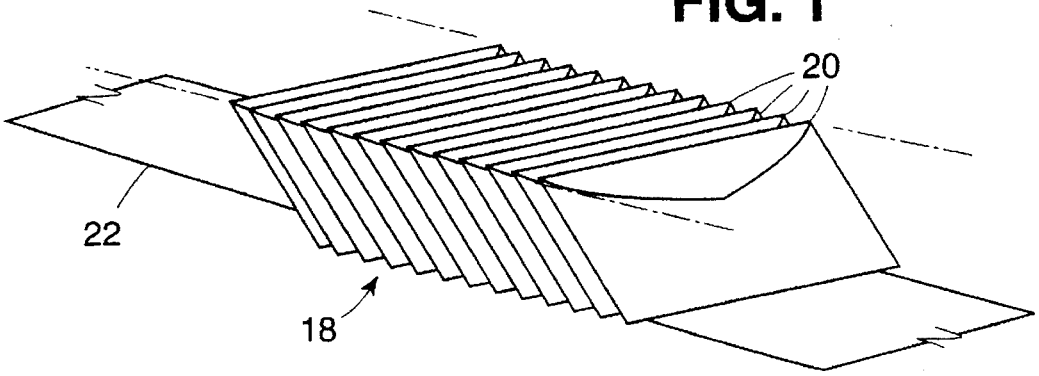
FIG. 1 is a perspective view of shingled envelopes lying at an angle on a flexible, supporting surface.
Figure 2:
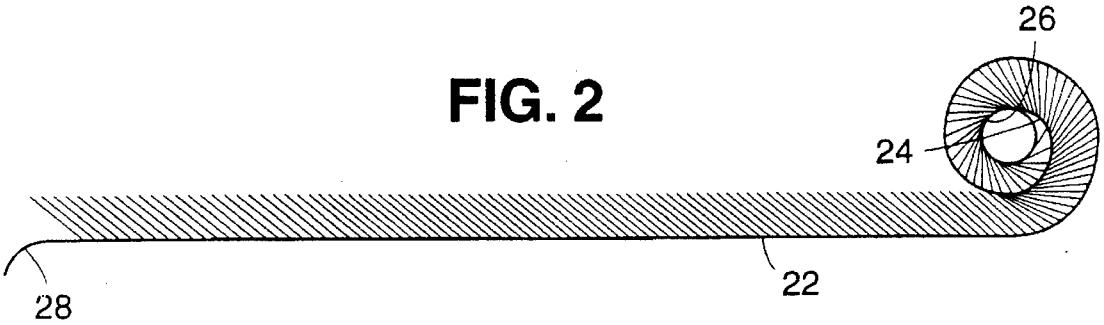
FIG. 2 is a side, elevational view of the shingled envelopes seen in FIG. 1 with one end wrapped around a core support.
Figure 3:
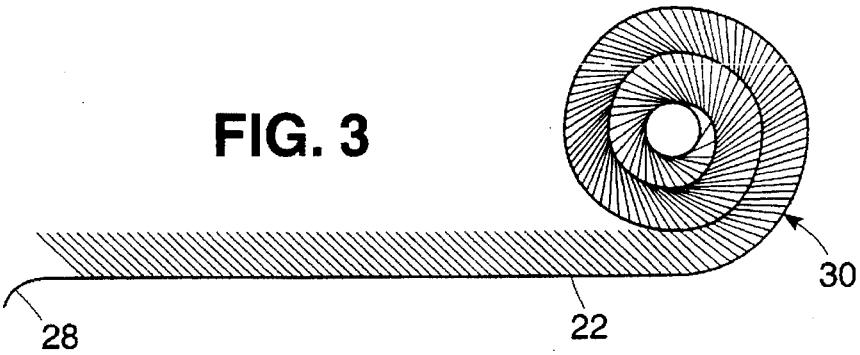
FIG. 3 is similar to FIG. 2 but shows the shingled envelopes with additional wrapping around the core support to begin forming a roll of envelopes.
Figure 4:
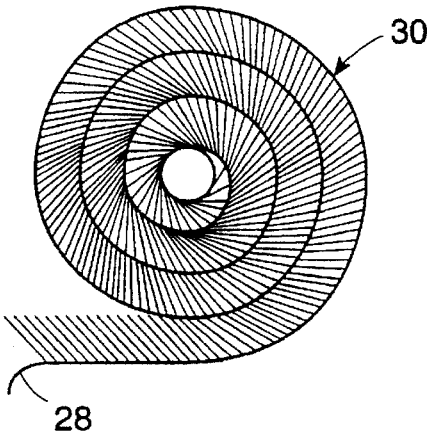
FIG. 4 is similar to FIG. 3 but shows the roll of envelopes with further wrapping.
Figure 5:
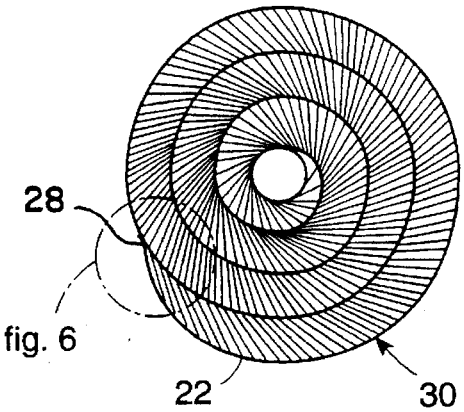
FIG. 5 is similar to FIG. 4 but shows a completed roll of shingled envelopes with a strap attached to the roll in a shippable fashion.

In describing the preferred embodiment of the instant invention, reference is made to the drawings, wherein there is seen in FIG. 1 a shingled stack 18 of envelopes 20 lying on a flexible, supporting substrate 22. In FIG. 2 is seen one end 24 of the stack 18 wrapped around a core 26 and FIG. 3 shows the stack 18 more progressively wrapped around the core 26. Also, the stack 18 is made more stable by having the substrate 22 extending from the core 26 at its end 28 backward beneath the shingled stack 18. As the stack 18 is wrapped around the core 26 the substrate 22 contains the outer edges of the stack 18 as it is being wrapped and allows a more orderly roll 30 to be developed (see FIG. 3). FIGS. 3 and 4 show the roll 30 as it continues to be wrapped around the core 26. The wrapping can be continued until a suitable sized roll 30 is developed. The roll 30 can be formed with the shingle running in either direction, and with variable amounts of shingle density. Although the roll 30 is most easily formed by shingling the envelopes 20 on their short dimension, the roll 30 can also be created by shingling the envelopes 20 on their long dimension. FIG. 5 shows the completed roll 30 (having any desired diameter) in a shippable fashion. A strap can be used (not shown) to secure the roll 30 for shipping. The rolls 30 can be stacked, palletized, or hung by their core 26 for shipment.

By situating a shingled forms unwinder 40 (see FIG. 7) adjacent an inserting system 42 (see FIGS. 10 and 11), a shingled stream of completed forms may be fed into any one or all of the material feed stations of the inserting system 42. The forms could include virtually anything that would end up as the contents of a mailpiece, such as sheets, folded sheets, accumulations, enclosures, stitched material, etc.

Figure 7:
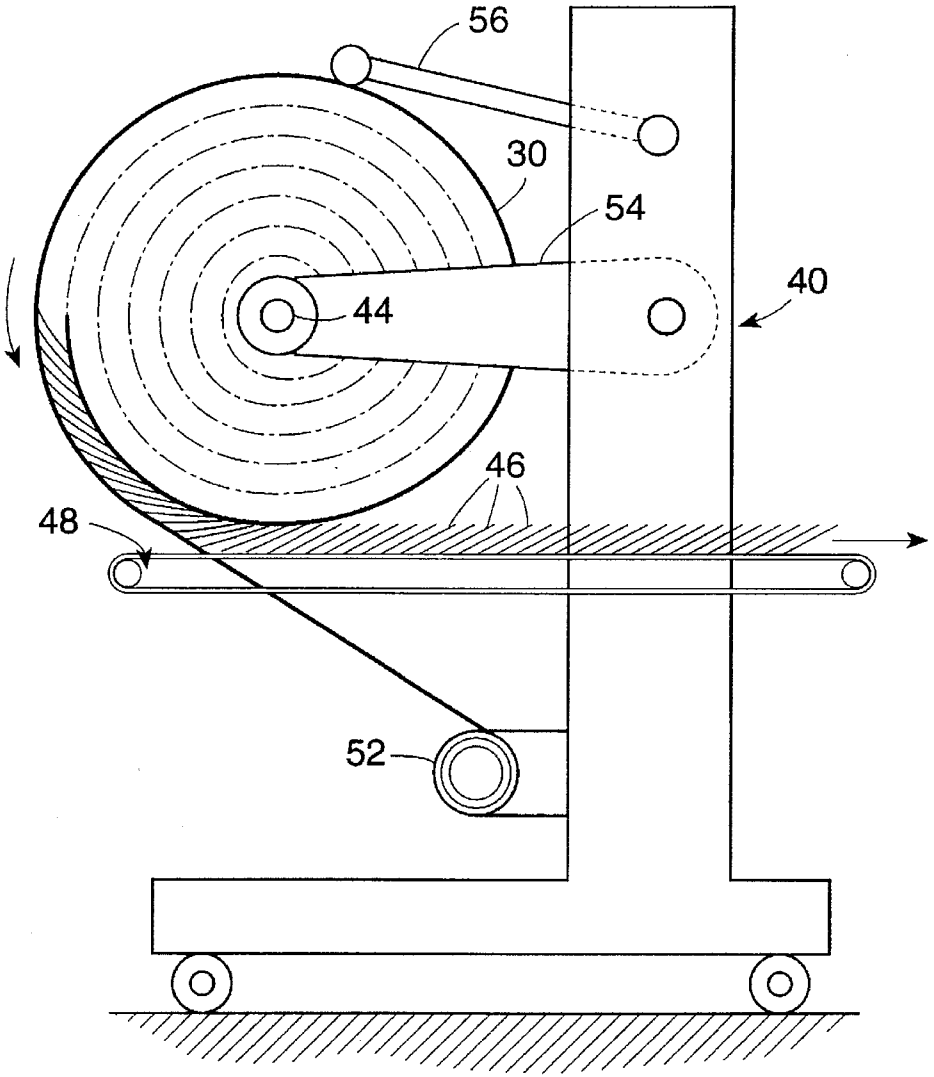
FIG. 7 is a side, elevational view of apparatus for unwinding the roll seen in FIG. 5.
Figure 6:
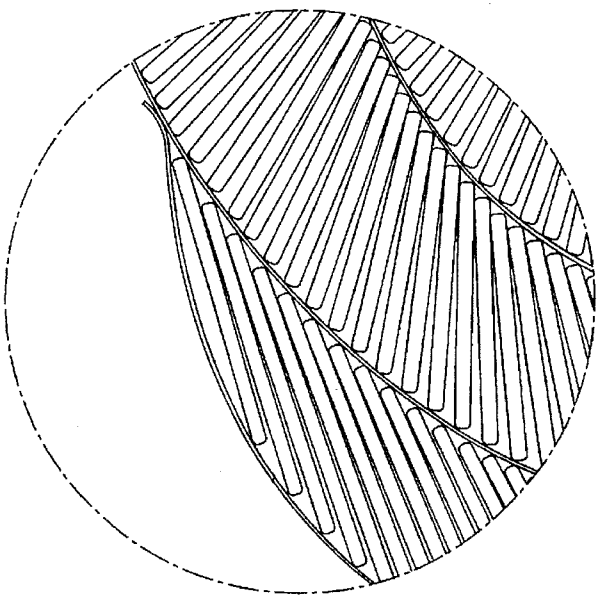
FIG. 6 is an enlarged view of the circled area indicated in FIG. 5.
Figure 9:
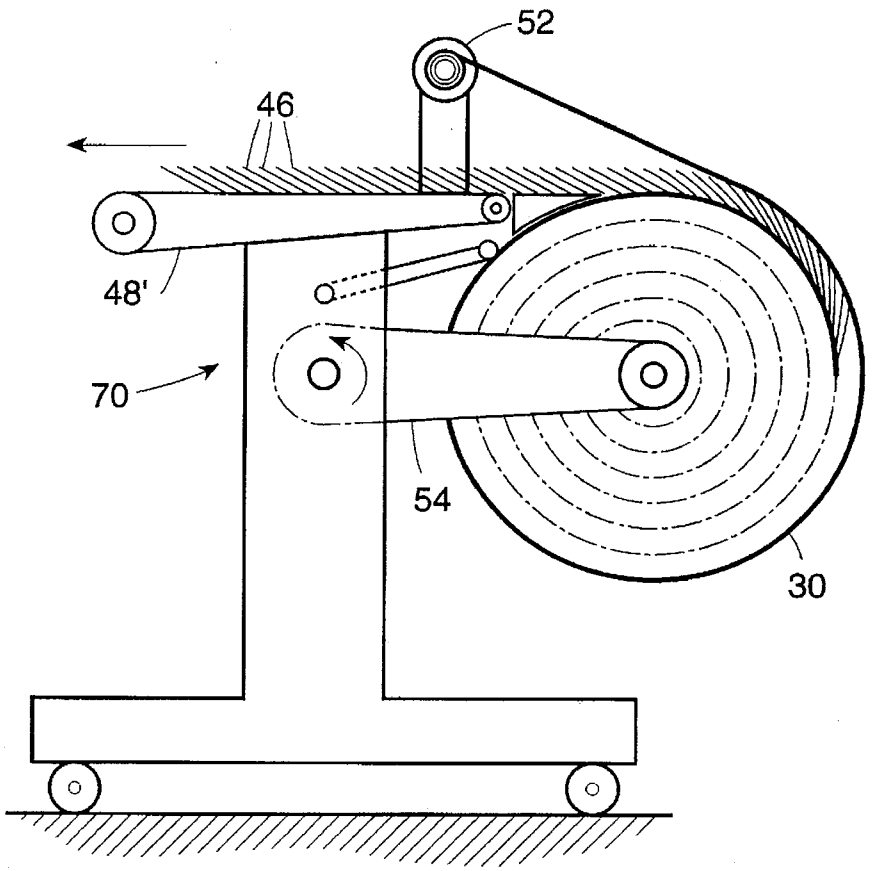
FIG. 9 is also similar to FIG. 7 but shows a second, alternative, unwinding apparatus in which the roll is located under the conveyor.
Figure 8:
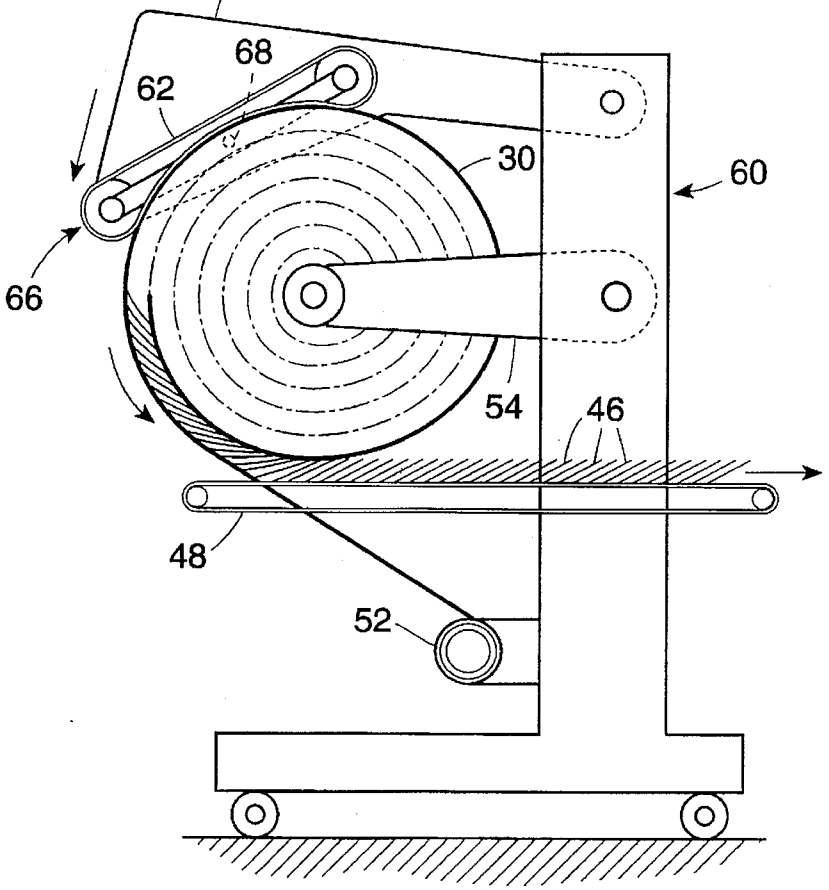
FIG. 8 is similar to FIG. 7 but shows an alternative, unwinding apparatus employing a peripheral drive belt.

FIGS. 7–9 depict mechanisms to supply rolled material to an inserter feed device. FIG. 7 illustrates a shingled forms unwinder 40 in which the roll 30 is driven by an axle 44 which supports and engages the core 26. The shingled forms 46 are deposited on a conveyor 48 located beneath the roll 30. The axle 44 and the forms conveyor 48 are driven in concert when the roll 30 needs to be advanced in order to deposit the forms 46 into the material hopper of a feed device.

A substrate rewind spool 52 winds the substrate 22 as it is unwound from the roll 30. The support arm 54 pivots downward as the roll 30 is depleted to allow for the decreasing radius of the roll 30. A diameter sensing arm 56 provides continual feedback controlling the required velocity relationships of the axle 44, the conveyor 48 and the rewind spool 52 as the forms 46 are depleted.

FIG. 8 shows an alternative, shingled forms unwinder 60 which provides the unwinding motion through the use of a peripheral drive belt 62, which is a component of a belt carriage 64 which pivots downward as the roll 30 is depleted to accommodate the decreasing radius of the roll 30. The drive belt 62 is part of a belt assembly 66 which pivots about a support 68 to accommodate the changing, angular relationship between the belt assembly 66 and the support arm 54.

A third, alternative, shingled forms unwinder 70 is shown in FIG. 9. In this embodiment, the roll 30 is located beneath the conveyor 48', and the forms 46 are stripped off onto the conveyor 48' through the drive of the axle 44. The support arm 54 in this embodiment rises as the forms 46 are depleted in order to maintain appropriate geometries. Alternatively, instead of the forms 46 being stripped through the drive of the axle 44, the roll 30 can be driven by a peripheral belt as with tile embodiment seen in FIG. 8.

Figure 11:
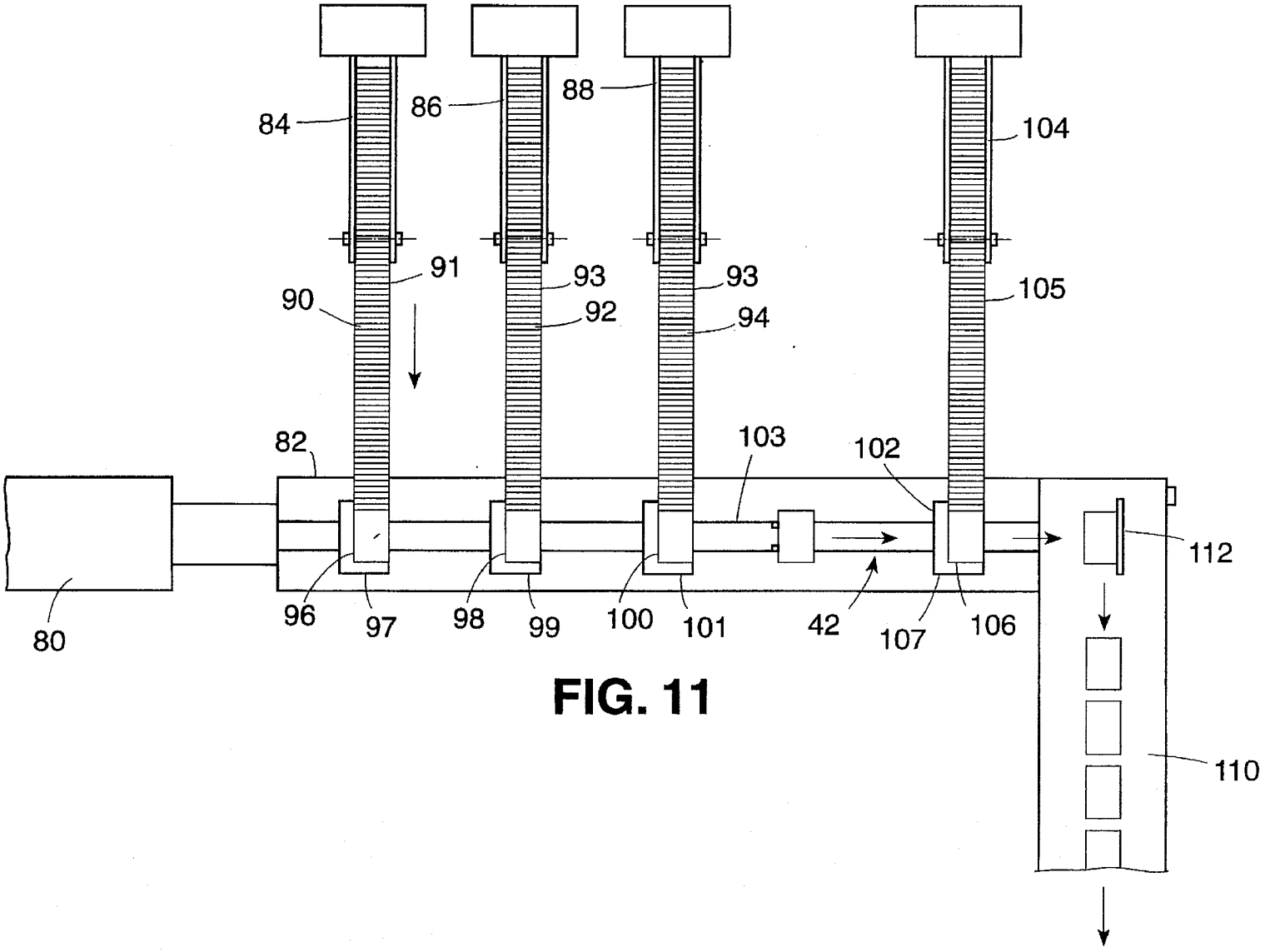
FIG. 11 is a top, plan view of an inserter system utilizing the roll unwinding apparatus of the instant invention.

FIG. 11 represents an inserter system 42 which includes a feeder 80 for feeding an address bearing document to an inserter chassis 82. Three shingled forms unwinders 84, 86 and 88 unwind enclosures 90, 92 and 94 respectively from rolls 91, 93 and 95 respectively into the hoppers 96, 98 and 100 of feeders 97, 99 and 101 respectively which feed the enclosures 90, 92 and 94 respectively to a transport mechanism 103 of the inserter chassis 82 which transports the enclosures 90, 92 and 94 downstream toward an envelope inserting device 102. An unwinder 104 unwinds envelopes 20 from a roll (not shown) into a hopper 106 of a feeder 107 which transports the envelopes 20 to the envelope inserting device 102 which inserts an address bearing document and the enclosures 90, 92 and 94 into an opened, waiting envelope 20. The minimum integration between the unwinders 84, 86, 88 and 104 and the inserting system 42 is an under/over limit type of device usually consisting of two photocells in vertical orientation (not shown) located in the hoppers 96, 98, 100 and 106. This arrangement will communicate to the respective unwinder when the associated hopper has been sufficiently depleted (i.e. lower photocell open). The unwinder must then advance, replenishing the supply of material until the sensing device indicates that a sufficient quantity of material has been deposited into the hopper (i.e. upper photocell blocked) of the feeder. The foregoing communication can be effected also by other logic which may specify each time a form is fed from the feeder the shingled forms unwinder deposits another form (or forms) in the feed hopper. After each envelope 20 is stuffed with inserts, it is transported to a transport 110 having a turning device 112. The transport 110 conveys the stuffed envelope downstream for further processing, such as a mailing machine which imprints a postage indicia.

Figure 10:
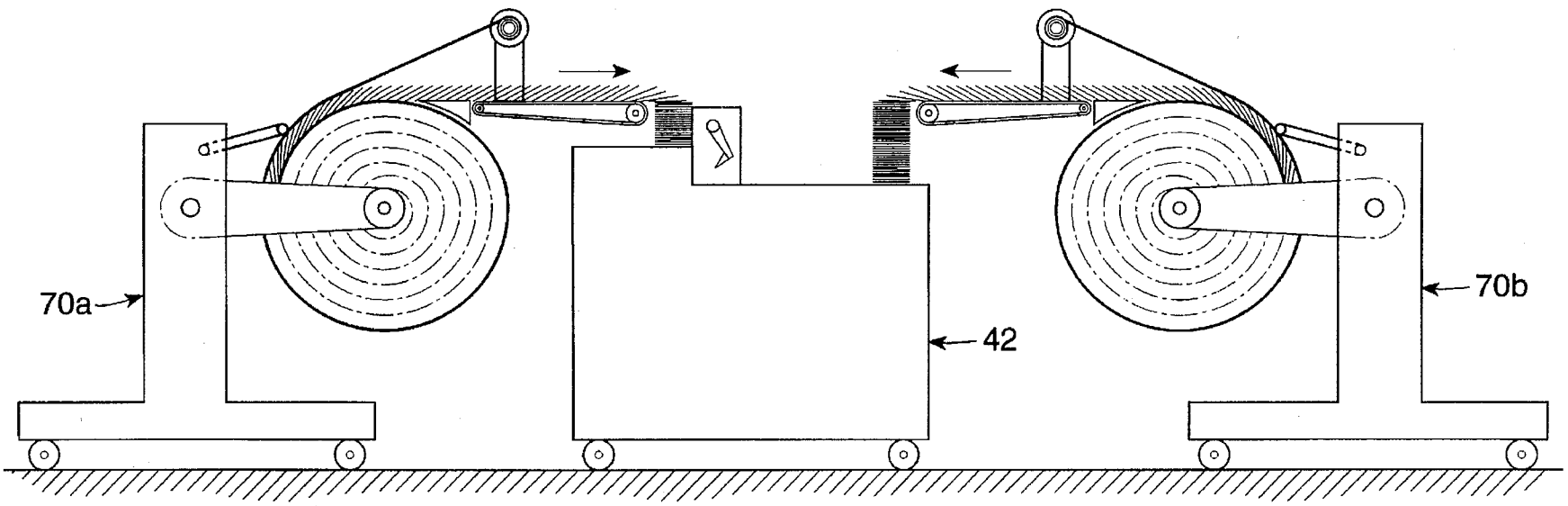
FIG. 10 is a side, elevational view of unwinders seen in FIG. 9 flanking an inserter chassis.

FIG. 10 is a side view of an inserting system 42 in which a shingled forms unwinder 70(*a*) and a shingled envelope unwinder 70(*b*) flank the inserting system 42.

From the foregoing description,, it can be seen that use of rolls of shingled materials can help expedite and automate the insertion process associated with placing enclosures into an envelope. An additional benefit comes from the simple packaging scheme of the rolls that require little or no packing material. The roll arrangement of shingled materials greatly reduces or eliminates the need for and disposal of the packaging waste. It should be noted that the shingled materials can comprise, in addition to flat sheets of paper and envelopes, booklets, coupons or any other material that can be inserted into an envelope.

It should be noted that each roll of shingled material can contain anywhere from 20 to 100 times as much material (or greater depending on desired roll diameter) as can be loaded into the hopper area of a conventional feed device. Thus, an operator can set up the system and let it run unattended for extended periods of time. The rolls of material may be staged on additional shingled forms unwinding assemblies that can be easily rolled up to the system and integrated as other rolls of material are depleted.

It should be understood by those skilled in the art that various modifications may be made in the present invention without departing from the spirit and scope thereof, as described in the specification and defined in the appended claims.

What is claimed is:

1. An inserting system for inserting documents into an envelope, comprising:

an inserting chassis;

means to convey documents from an upstream location on said chassis to a downstream location on said chassis;

an insertion station for inserting said documents into a waiting envelope;

a feeder located adjacent said inserter chassis for feeding documents to said conveying means, said feeder having a hopper for storing said documents;

a forms unwinder located adjacent said feeder, said unwinder having a pivotable support arm;

a roll of shingled documents mounted on said support arm;

means for unwinding said roll and separating each succeeding document seriatim; and means for feeding said separated documents into said feeder hopper.

2. The apparatus of claim 1, additionally comprising an envelope feeder adjacent said insertion station, an envelope unwinder located adjacent said envelope feeder, said envelope unwinder having a pivotable support arm, a roll of shingled envelopes mounted on said envelope unwinder support arm, means for unwinding said roll of shingled envelopes and separating each succeeding envelope seriatim, and means for feeding said separated envelopes into said envelope feeder.

3. An inserting system for inserting documents into an envelope, comprising:

an inserting chassis;

means to convey documents from an upstream location on said chassis to a downstream location on said chassis;

an insertion station for inserting said documents into a waiting envelope;

a feeder located adjacent said inserter chassis for feeding documents to said conveying means, said feeder having a hopper for storing said documents;

an envelope feeder adjacent said insertion station;

an envelope unwinder located adjacent said envelope feeder, said envelope unwinder having a pivotable support arm;

a roll of shingled envelopes mounted on said envelope unwinder support arm;

means for unwinding said roll of shingled envelopes and separating each succeeding envelope seriatim; and means for feeding said separated envelopes into said envelope feeder.

4. The apparatus of claim 2, wherein said pivotable support arm pivots downward as the roll is unwound.

5. The apparatus of claim 4, wherein said unwinding means include an axle mounted on said support arm.

6. The apparatus of claim 5, additionally comprising a diameter sensing arm for sensing the diameter of the roll as it unwinds to thereby provide continual feedback controlling the required velocity of the axle.

* * * * *